US008027599B2

(12) United States Patent
Kwon

(10) Patent No.: US 8,027,599 B2
(45) Date of Patent: Sep. 27, 2011

(54) IMAGE FORMING APPARATUS

(75) Inventor: Joong Kil Kwon, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 378 days.

(21) Appl. No.: 12/041,859

(22) Filed: Mar. 4, 2008

(65) Prior Publication Data

US 2008/0232831 A1 Sep. 25, 2008

(30) Foreign Application Priority Data

Mar. 22, 2007 (KR) ..... 10-2007-0028317

(51) Int. Cl.
*G03G 15/20* (2006.01)

(52) U.S. Cl. ..... 399/33; 399/44; 399/67

(58) Field of Classification Search ..... 399/33, 399/44, 67, 69

See application file for complete search history.

(56) References Cited

U.S. PATENT DOCUMENTS 4,994,852 A * 2/1991 Matsuuchi et al. ..... 399/33
2002/0057919 A1* 5/2002 Tomatsu ..... 399/69

FOREIGN PATENT DOCUMENTS

JP 2004-184608 7/2004
KR 2005-67614 7/2005

OTHER PUBLICATIONS

Chinese Office Action issued Aug. 28, 2009 in CN Application No. 200810081779.9.

* cited by examiner

*Primary Examiner* — David Gray
*Assistant Examiner* — Barnabas T Fekete
(74) *Attorney, Agent, or Firm* — Stanzione & Kim, LLP

(57) ABSTRACT

An image forming apparatus includes an overheat prevention device to control a heater based on a fusing temperature detected by a temperature sensor within a predetermined range when a controller generates an abnormal heater control signal.

20 Claims, 6 Drawing Sheets

IMAGE FORMING APPARATUS

CROSS-REFERENCE TO RELATED APPLICATIONS

This application claims the benefit under 35 U.S.C. §119 (a) from Korean Patent Application No. 2007-0028317, filed on Mar. 22, 2007 in the Korean Intellectual Property Office, the disclosure of which is incorporated herein by reference in its entirety.

BACKGROUND OF THE INVENTION

1. Field of the Invention

The present general inventive concept relates to an image forming apparatus to cope with an error of a controller to control a fusing temperature.

2. Description of the Related Art

An electrophotographic image forming apparatus, such as a printer, multifunction printer or the like, includes a fusing device for fusing a toner image transferred onto print paper.

The fusing device is adapted to actuate a heater through a controller to melt toner powder transferred onto the print paper.

The controller is adapted to control a fusing temperature based on a predetermined reference fusing temperature to cope with an excessive increase in the fusing temperature resulting from a malfunction in the fusing device or an electric circuit supplying power to the heater.

Together with this operation of controlling the fusing temperature, the controller acts to perform an operation of compulsorily cutting off power to the heater by a bimetal when the fusing temperature increases excessively.

On the other hand, the heater may be erroneously actuated due to an abnormal output of the controller. Where the heater is erroneously actuated in response to a control command from the controller, the fusing temperature rises. At the time that the fusing temperature rises excessively, the actuation of the heater is stopped by the bimetal and the fusing temperature thus falls. However, even though the fusing temperature falls just a little, the cut-off operation by the bimetal is released, so that the heater is again actuated by the control command from the controller. As a result, in spite of the fact that a fusing process is not actually required, a high fusing temperature may be maintained due to a wrong control command resulting from an error in the controller, so that the fusing device may be so overheated as to melt the structure thereof.

SUMMARY OF THE INVENTION

The present general inventive concept provides an image forming apparatus to cope with an error of a controller to control a fusing temperature of a fusing device, so as to prevent the fusing device from being overheated.

Additional aspects utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an image forming apparatus including a fusing device including a heater, a temperature sensor to detect a fusing temperature varying with an operation of the heater, a controller to output a heater control signal to control the heater based on the detected fusing temperature, and an overheat prevention device to control the heater to prevent overheating of the fusing device when the heater control signal is abnormal due to an error of the controller.

The temperature sensor may be a thermistor whose resistance decreases according to an increase in the fusing temperature to output a lower-voltage signal.

The controller may output the heater control signal such that the detected fusing temperature varies within a first temperature range, and the overheat prevention device may control the heater such that the detected fusing temperature varies within a second temperature range including the first temperature range.

The controller may compare the detected fusing temperature with a predetermined reference fusing temperature and output the heater control signal according to a result of the comparison, and the reference fusing temperature may belong to the first temperature range.

The image forming apparatus may further comprise a temperature switch electrically connected to the heater, the temperature switch compulsorily cutting off power to the heater when the detected fusing temperature reaches an overheat protection temperature, and the second temperature range may include an upper temperature limit set to be lower than the overheat protection temperature.

The temperature switch may be a bimetal.

The overheat prevention device may include a comparator to change an output voltage thereof with a fusing temperature signal corresponding to the fusing temperature detected by the temperature sensor, a first switch to perform a switching operation in response to the heater control signal from the controller to control the heater, and a second switch to perform a switching operation in response to the output voltage of the comparator to control the heater independent of the first switch.

The comparator may have an inverting terminal to receive a voltage of the fusing temperature signal, a non-inverting terminal to receive a reference voltage, and an output terminal connected to the non-inverting terminal.

The voltage inputted to the inverting terminal of the comparator may become lower than the voltage inputted to the non-inverting terminal of the comparator when the detected fusing temperature reaches an upper temperature limit of the second temperature range, and higher than the voltage inputted to the non-inverting terminal of the comparator when the detected fusing temperature reaches a lower temperature limit of the second temperature range.

The image forming apparatus may further include a power switch to switch power to be supplied to the heater, and the overheat prevention device may control an operation of the power switch such that the fusing temperature varies within a predetermined range.

The foregoing and/or other aspects and utilities of the present general inventive concept may also be achieved by providing an image forming apparatus including a fusing device including a heater, a power switch to switch power to be supplied to the heater, a temperature sensor to detect a fusing temperature varying with an operation of the heater, a controller to compare the detected fusing temperature with a predetermined reference fusing temperature and to output a heater control signal to control the heater according to a result of the comparison such that the detected fusing temperature varies within a first temperature range, and an overheat prevention device to control the heater such that the detected fusing temperature varies within a second temperature range including the first temperature range.

The image forming apparatus may further include a bimetal for compulsorily cutting off the power to the heater when the detected fusing temperature is higher than an overheat protection temperature and supplying the power to the heater when the detected fusing temperature is not higher than the overheat protection temperature, and the second temperature range may include an upper temperature limit set to be lower than the overheat protection temperature.

The overheat prevention device may include a comparator to change an output voltage thereof with a fusing temperature signal corresponding to the fusing temperature detected by the temperature sensor, a first switch to perform a switching operation in response to the heater control signal from the controller to control the heater, and a second switch to perform a switching operation in response to the output voltage of the comparator to control the heater independent of the first switch. The comparator may have an inverting terminal to receive a voltage of the fusing temperature signal, a non-inverting terminal to receive a reference voltage, and an output terminal connected to the non-inverting terminal. The voltage inputted to the inverting terminal of the comparator may become lower than the voltage inputted to the non-inverting terminal of the comparator when the detected fusing temperature reaches an upper temperature limit of the second temperature range, and higher than the voltage inputted to the non-inverting terminal of the comparator when the detected fusing temperature reaches a lower temperature limit of the second temperature range.

The foregoing and/or other aspects and utilities of the present general inventive concept may also be achieved by providing an image forming apparatus including a fusing device to fuse an image on a printing medium, a temperature sensor to detect a fusing temperature of the fusing device, a controller to control the fusing device according to the detected fusing temperature and a first reference, and an overheat prevention device to control the fusing device according to the detected fusing temperature and a second reference such that one of the controller and the overheat prevention device controls the fusing device when the other one of the controller and the overheat prevention device does not control the fusing device.

The fusing device may include a heater to generate heat to fuse the image, and the overheat prevention device may control the heater when the controller is in an abnormal state in which the heater is kept being turned on.

The fusing device may include a heater to generate heat to fuse the image, and the overheat prevention device controls the heater when the controller controls the heater to keep being turned on in an abnormal state.

The overheat prevention device may include a comparing unit to generate a signal; the controller generates another signal, and the fusing device comprises a heater to be turned on and off according to one of the signal and the another signal to maintain the fusing temperature in a predetermined range.

The second reference may include a value range between a first value and a second value to represent a temperature range, and the overheat prevention device may control the fusing device according to the detected fusing temperature and one of the first value and the second value.

The second reference may include a value range between a first value and a second value to represent a temperature range, and the first reference may be in the value range.

The controller and the overheat prevention device may independently control the fusing device.

The foregoing and/or other aspects and utilities of the present general inventive concept may also be achieved by providing an image forming apparatus including a fusing device including a heater to fuse an image on a printing medium, a temperature sensor to detect a fusing temperature varying with an operation of the heater of the fusing device, a controller to output a heater control signal to control the heater of the fusing device based on the detected fusing temperature and a first reference, and an overheat prevention device to control the heater of the fusing device according to the detected fusing temperature and a second reference such that one of the controller and the overheat prevention device controls the fusing device when the other one of the controller and the overheat prevention device does not control the fusing device, and to prevent overheating of the fusing device when the heater control signal of the controller is abnormal.

The foregoing and/or other aspects and utilities of the present general inventive concept may also be achieved by providing an image forming apparatus including a fusing device including a heater to fuse an image on a printing medium, a temperature sensor to detect a fusing temperature varying with an operation of the heater of the fusing device, a controller to output a heater control signal according to the detected fusing temperature and a first reference, and an overheat prevention device to generate another heater control signal, and having a logic unit to control the fusing device according to at least one of the heater control signal and the another heater controller signal.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
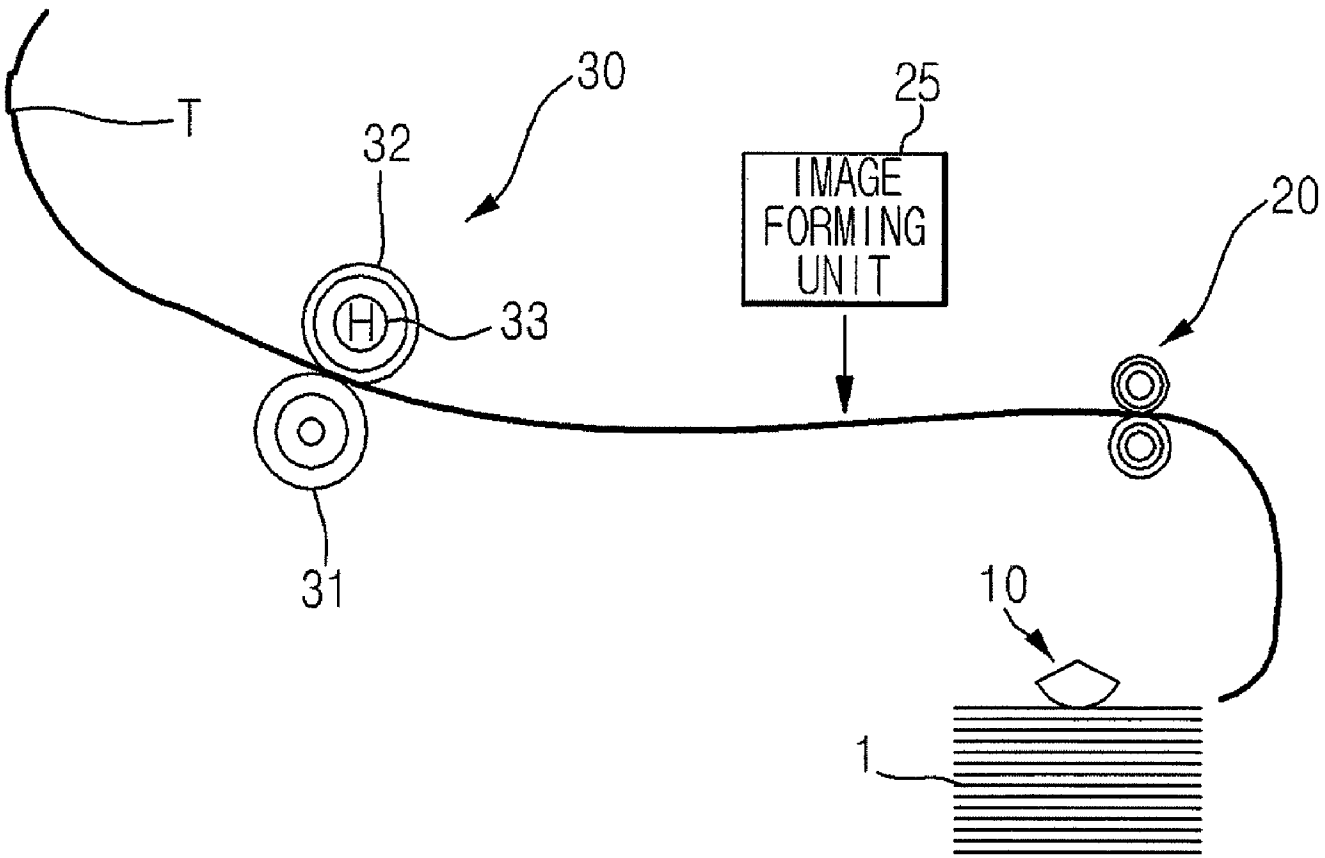
FIG. 1 is a schematic view illustrating an image forming apparatus having a fusing device provided on a paper feeding path according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

An image forming apparatus according to an exemplary embodiment of the present general inventive concept will hereinafter be described with reference to the accompanying drawings.

As illustrated in FIG. 1, a printing medium, such as print paper 1, is fed sheet by sheet to a registration roller 20 by a feed roller 10 installed on an upstream of a paper feeding path T so as to be subjected to development and/or transfer processes. An image forming unit 25 performs the development and/or transfer processes to develop and/or transfers an image (toner image) to the print paper. And then, the resulting print paper 1 passes through a fusing device 30, which fixes the toner image transferred onto the print paper 1.

The fusing device 30 includes a pressurizing roller 31 and a heating roller 32 disposed facing each other for applying pressure and heat to the paper, respectively. The heating roller 32 has a heater 33 longitudinally extending inside the roller 32.

Figure 2:
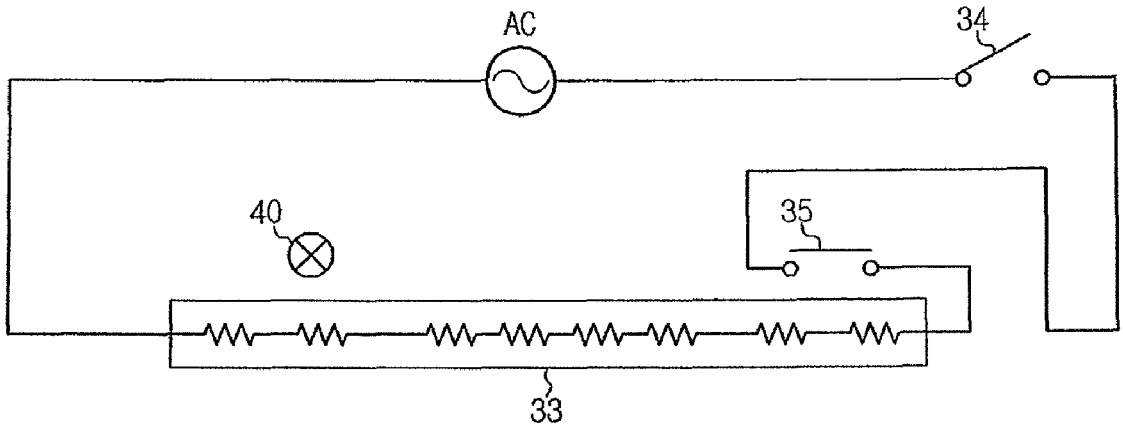
FIG. 2 is a schematic view illustrating an operation of supplying power to a heater which is applied to the image forming apparatus of FIG. 1.

As illustrated in FIG. 2, the heater 33 is electrically connected to a power source, such as a commercially available alternating current (AC) power source AC, so as to be supplied with power from the power source. A halogen lamp may be used as the heater 33. A power switch 34 and a temperature switch 35 are connected in series between the heater 33 and the commercial AC power source AC. A fusing temperature sensor 40 is installed in the vicinity of the heater 33 to detect a fusing temperature and output a fusing temperature signal corresponding to the detected fusing temperature. The fusing temperature sensor 40 may be implemented with a thermistor having a negative resistance characteristic that resistance decreases as temperature increases. As a result, the fusing temperature sensor 40 outputs a fusing temperature signal of a lower voltage when the fusing temperature is higher.

The power switch 34 acts to switch power to be supplied to the heater 33. When the fusing temperature is lower than a reference fusing temperature, the power switch 34 is turned on such that the heater 33 performs heating. Conversely, when the fusing temperature is higher than the reference fusing temperature, the power switch 34 is turned off such that the heater 33 stops the heating. The temperature switch 35 may be implemented with a bimetal. The temperature switch 35 is turned off when the fusing temperature reaches an overheat protection temperature for protection of the apparatus due to an excessive increase thereof, and on when the fusing temperature falls below the overheat protection temperature.

Figure 3:
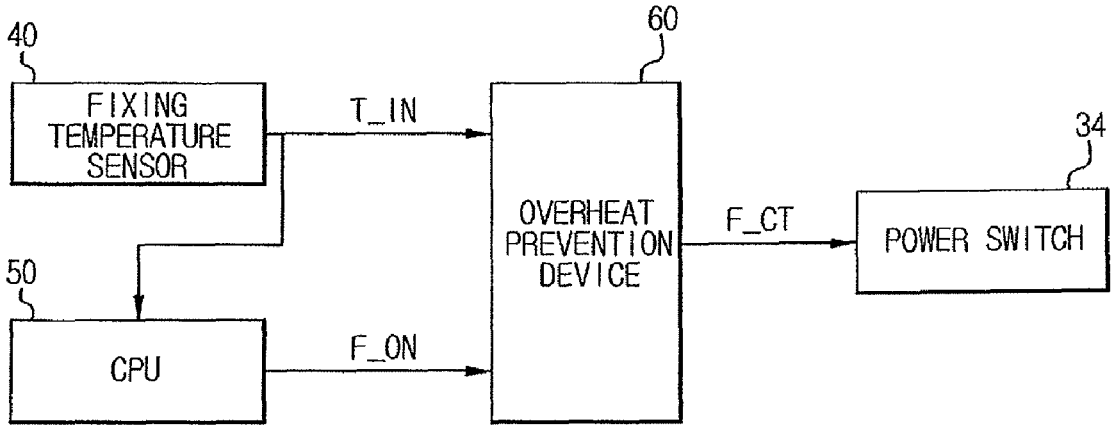
FIG. 3 is a control block diagram illustrating the image forming apparatus of FIG. 1.

Referring to FIGS. 1-3, an overheat prevention device 60 is provided in the image forming apparatus according to the present embodiment to cope with or compensate for a problem that the heater may be erroneously actuated due to an abnormal output of a controller 50, that is, a controller error.

The fusing temperature sensor 40 and the controller 50 are connected to the input of the overheat prevention device 60, and the power switch 34 is connected to the output of the overheat prevention device 60.

The fusing temperature sensor 40 provides a fusing temperature signal T_IN corresponding to a detected fusing temperature to each of the controller 50 and overheat prevention device 60.

The controller 50 controls the entire printing operation in response to a user command. Particularly, the controller 50 compares the fusing temperature detected by the fusing temperature sensor 40 with a predetermined reference fusing temperature and outputs a heater control signal F_ON for control of the heater 33 according to a result of the comparison.

The overheat prevention device 60 outputs a switch control signal F_CT for control of the heater 33 to the power switch 34 in response to the fusing temperature signal T_IN from the fusing temperature sensor 40 and the heater control signal F_ON from the controller 50.

The power switch 34 is turned on or off by the switch control signal F_CT.

The overheat prevention device 60 responds appropriately to an abnormal heater control signal F_ON from the controller 50 resulting from an error in the controller 50, as well as to a normal heater control signal F_ON from the controller 50. That is, the overheat prevention device 60 acts to not only control the power switch 34 in response to the normal heater control signal to control the heater 33, but also prevent the heater 33 from being erroneously actuated even though the abnormal heater control signal is inputted due to an error in the controller 50.

Figure 4:
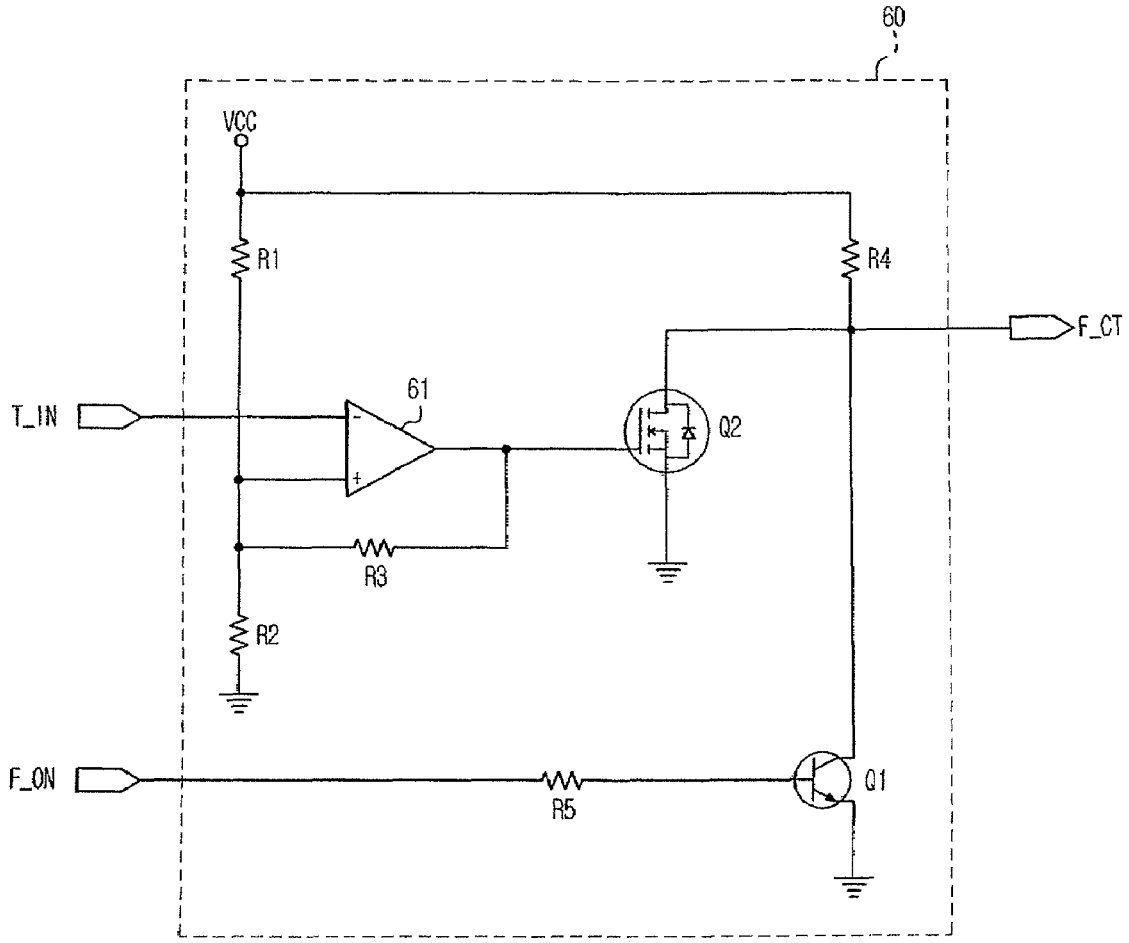
FIG. 4 is a detailed circuit diagram illustrating an overheat prevention device of the image forming apparatus of FIGS. 1 and 3.

The operation of this overheat prevention device 60 will hereinafter be described in detail with reference to FIGS. 4 and 5.

The overheat prevention device 60 includes a comparator 61, a first switch Q1, and a second switch Q2.

The comparator 61 compares a voltage of the fusing temperature signal T_IN inputted to an inverting terminal—thereof with a voltage inputted to a non-inverting terminal "+" thereof and outputs a voltage corresponding to a difference between the two voltages. A drive voltage source VCC is connected to the non-inverting terminal "+" through a resistor R1. The non-inverting terminal "+" is also connected to a ground terminal through a resistor R2 and to the output of the comparator 61 through a resistor R3.

The first switch Q1 has a base connected to the heater control signal F_ON of the controller 50 through a resistor R5, a collector connected to the drive voltage source VCC through a resistor R4, and an emitter connected to the ground terminal.

The second switch Q2 has a gate connected to the output of the comparator 61, a drain connected to the drive voltage source VCC through the resistor R4, and a source connected to the ground terminal.

Hereinafter, a case where a heater control signal from a controller is normal is explained with reference to FIGS. 1-5.

The controller 50 compares the fusing temperature detected by the fusing temperature sensor 40 with a reference fusing temperature preset for smooth execution of a fusing process and outputs the heater control signal F_ON to control the first switch Q1 according to a result of the comparison. The first switch Q1 is turned on or off depending on the heater control signal F_ON, thus turning on or off the power switch 34.

The voltage of the fusing temperature signal T_IN inputted to the inverting terminal "−" of the comparator 61 varies with the fusing temperature, and the output voltage of the comparator 61 thus varies.

In the case where the fusing temperature is not higher than the overheat protection temperature, the voltage of the fusing temperature signal T_IN inputted to the inverting terminal "−" of the comparator 61 becomes higher than the voltage Vt1 inputted to the non-inverting terminal "+" of the comparator 61, thereby causing an output voltage Vc of the comparator 61 to reach 0 V. As a result, the second switch Q2 is turned off.

The output voltage Vo of the comparator 61 is defined by the following equation.

$$Vc=((R2//R3)*VCC)/(R1+(R2//R3))$$

Here, R2//R3 is a combined resistance of the resistor R2 and resistor R3.

In this manner, when the controller 50 is normally operated, the power switch 34 can be controlled according to the switching operation of the first switch Q1, except a case where the temperature switch 35 is not operated because the fusing temperature rises above the overheat protection temperature due to a malfunction in the fusing device. Therefore, it is possible to properly maintain the fusing temperature based on the reference fusing temperature.

[CASE WHERE HEATER CONTROL SIGNAL FROM CONTROLLER IS ABNORMAL DUE TO ERROR IN

CONTROLLER] Hereinafter, a case where a heater control signal from a controller is abnormal is explained with reference to FIGS. 1-5

Where an error occurs in the controller 50 at a time A, the controller 50 may output an abnormal heater control signal F_ON to supply power to the heater 33 irrespective of the actual fusing temperature in a period B. In this case, however, the overheat prevention device 60 outputs the switch control signal F_CT such that the fusing temperature varies within a predetermined temperature range (between an upper temperature limit T1 and a lower temperature limit T2). The upper temperature limit T1 may be set to be higher than the reference fusing temperature, but lower than the overheat protection temperature at which the temperature switch 35 is not operated, and the lower temperature limit T2 may be set to be lower than the reference fusing temperature.

When there is a controller error, the first switch 34 cannot be properly controlled to turn on or off the power switch 34, and the heater 33 can be overheated. According to the present embodiment, the heater 33 can be controlled by an output of the comparator 61 and the second switch Q2 when the controller 50 cannot output a normal signal to the first switch 34 or cannot control the first switch 34.

Figure 5:
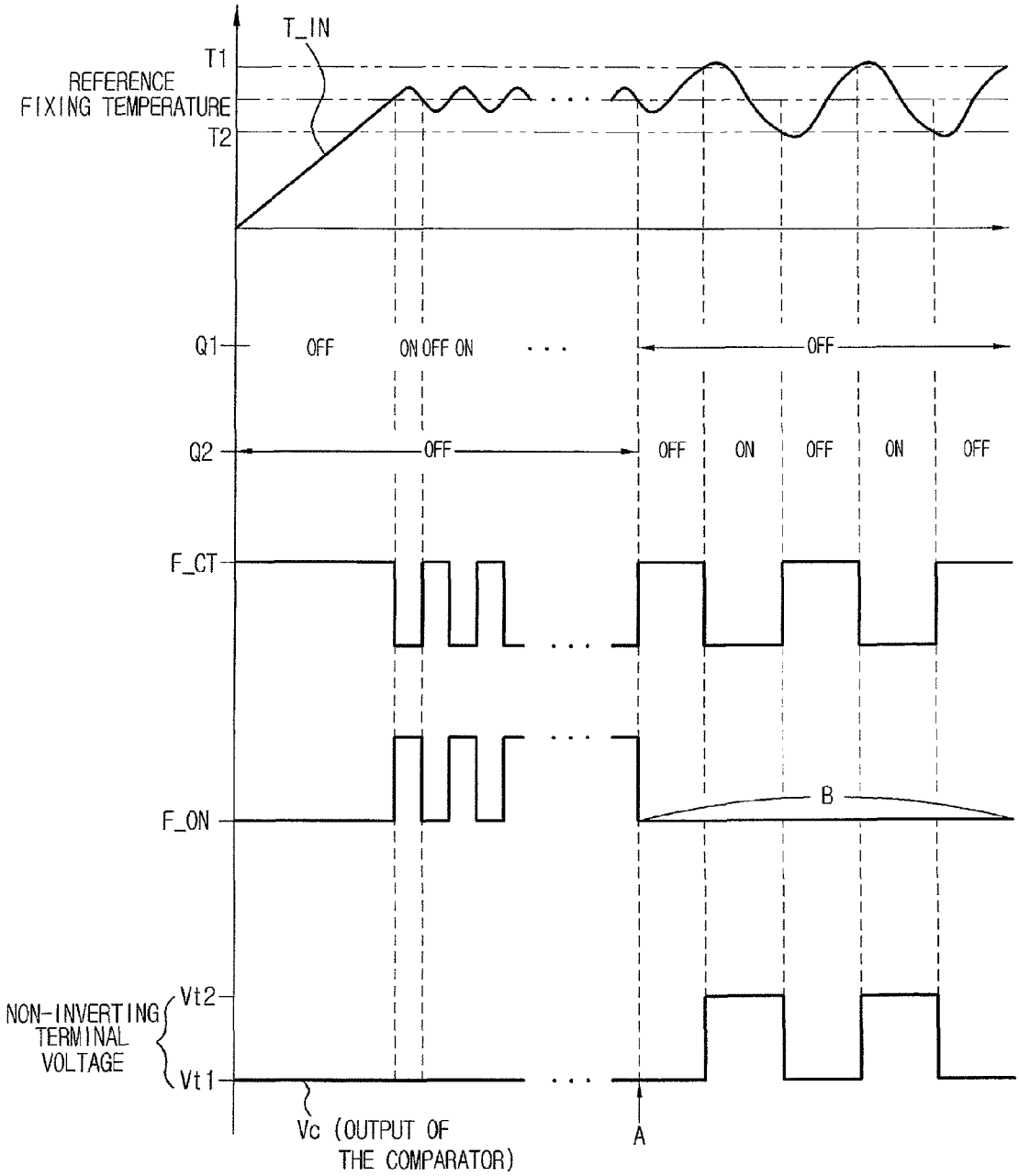
FIG. 5 is a timing diagram illustrating operations of respective components of the image forming apparatus of FIGS. 1-4.

Referring to FIG. 5, in a case where the fusing temperature rises above the reference fusing temperature due to the occurrence of an error in the controller 50 and then reaches the upper temperature limit T1, the voltage of the fusing temperature signal T_IN from the fusing temperature sensor 40 falls and the voltage Vt2 inputted to the inverting terminal "−" of the comparator 61 thus becomes lower than the voltage inputted to the non-inverting terminal "+" of the comparator 61, thereby causing the output voltage Vc of the comparator 61 to become VCC. As a result, the second switch Q2 is turned on.

The output voltage Vc is defined by the following equation.

$$Vc=(R2*VCC)/((R1//R3)+R2)$$

Here, R1//R3 is a combined resistance of the resistor R1 and resistor R3.

When the second switch Q2 is turned on, the voltage of the switch control signal F_CT is lowered, so as to turn off the power switch 34. Accordingly, the supply of power to the heater 22 is cut off, the heating operation is stopped, and the fusing temperature falls. At the time that the fusing temperature reaches the lower temperature limit T2, namely, the fusing temperature falls sufficiently, the voltage inputted to the inverting terminal "−" of the comparator 61 becomes higher than the voltage Vt1 inputted to the non-inverting terminal "+" of the comparator 61, so that the output voltage Vc of the comparator 61 reaches 0 V. At this time, the second switch Q2 is turned off and the voltage of the switch control signal F_CT thus rises, thereby causing the power switch 34 to be turned on. As a result, the heater 33 is supplied with power to perform the heating operation.

In this manner, even in the case where an error occurs in the controller 50, the overheat prevention device 60 can control the heater 33 by varying the output voltage of the comparator 61 with the difference between the voltages inputted to the inverting terminal "−" and non-inverting terminal "+" of the comparator 61 and operating the second switch Q2 based on the output voltage of the comparator 61. Therefore, the fusing temperature can vary within the predetermined temperature range (between T1 and T2), thereby preventing the fusing device from being overheated.

Figure 6:
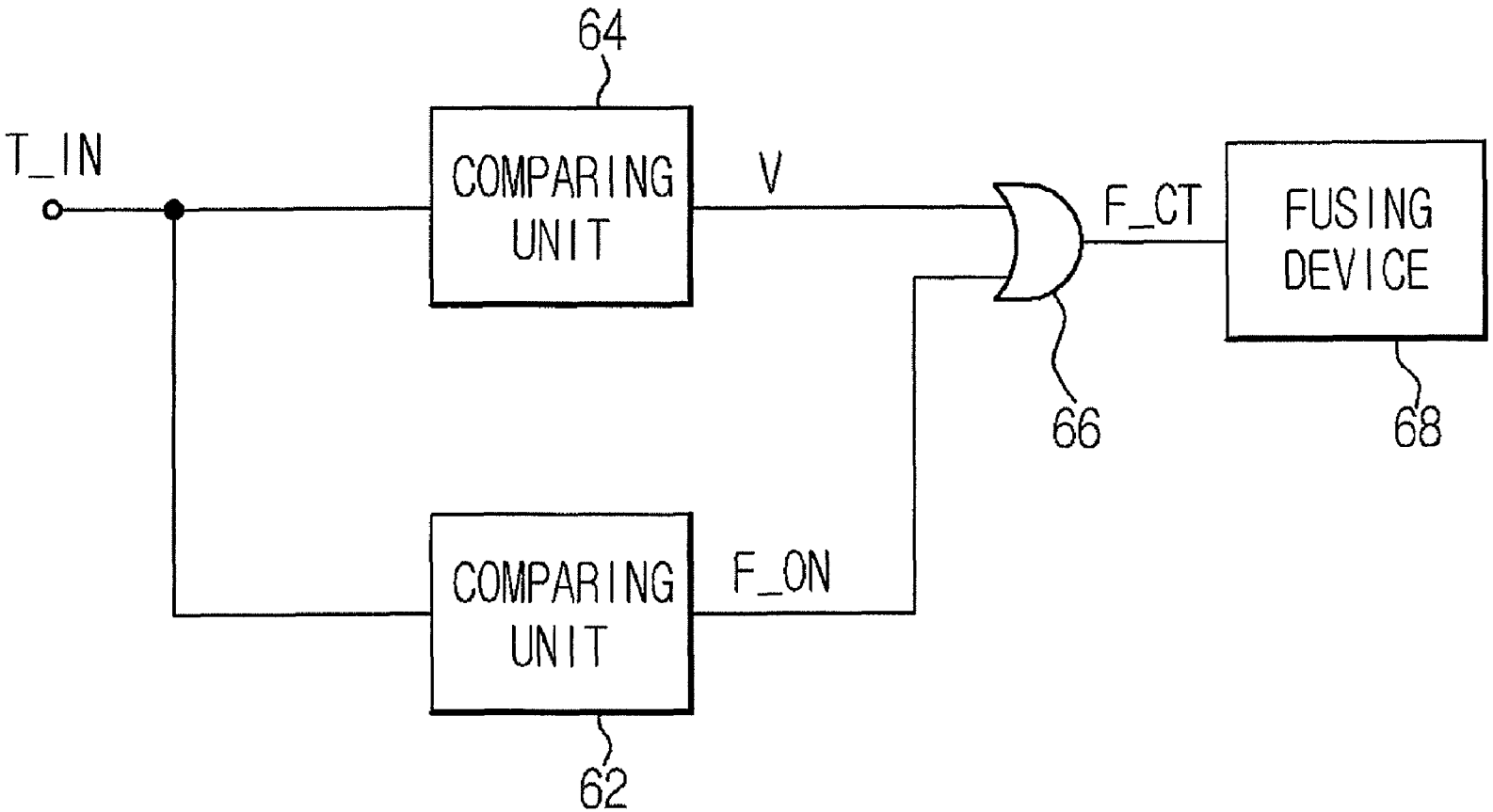
FIG. 6 is a diagram illustrating an image forming apparatus according to an embodiment of the present general inventive concept.

FIG. 6 is a view illustrating an image forming apparatus according to an embodiment of the present general inventive concept. The image forming apparatus of FIG. 6 may similar to the image forming apparatus of FIGS. 1-3. The image forming apparatus of FIG. 6 includes a first comparing unit 62 to compare the temperature signal T_IN from a fusing temperature detector with a first reference to generate a heater control signal F_ON, a second comparing unit 64 to compare the temperature signal T_IN from the fusing temperature detector with a second reference to generate an output signal V, and a logic unit 66, for example, an OR gate, to output a switch control signal F_CT to control a fusing device 68. The power switch 34 may be disposed between the OR gate 66 and the fusing device 68 to be controlled by the switch control signal F_CT together with the switch Q1 or Q2. Accordingly, the fusing device 68 can be controlled by at least one of the output signal V and the heater control signal F_ON. The switch control signal F_CT may be same as at least one of the output signal V and the heater control signal F_ON. The first and second references may be reference voltages. The first reference may be different from the second reference. It is possible that the second reference may have two different sub-references, which are similar to the voltages Vt1 and Vt2 of FIG. 5. The two different sub references may be higher and lower than the first reference, respectively.

As is apparent from the above description, according to the present general inventive concept, an operation of a power switch connected to a heater is controlled based on an output of a temperature sensor detecting a fusing temperature, in such a manner that the fusing temperature can vary within a proper range. Therefore, even though an error occurs in a controller controlling the fusing temperature, the fusing temperature can always be appropriately maintained, thereby making it possible to prevent a fusing device from being overheated.

Although a few embodiments of the present general inventive concept have been shown and described, it would be appreciated by those skilled in the art that changes may be made in these embodiments without departing from the principles and spirit of the general inventive concept, the scope of which is defined in the appended claims and their equivalents.

What is claimed is:

1. An image forming apparatus comprising:

a fusing device including a heater;

a temperature sensor to detect a fusing temperature varying with an operation of the heater;

a controller to output a heater control signal to control the heater based on the detected fusing temperature such that the detected fusing temperature varies within a first temperature range; and an overheat prevention device to control the heater to prevent overheating of the fusing device when the heater control signal of the controller is abnormal, wherein the overheat prevention device controls the heater when the heater control signal of the controller is abnormal due to an error on the controller, such that the detected fusing temperature varies within a second temperature range including the first temperature range.

2. The image forming apparatus according to claim 1, wherein the temperature sensor is a thermistor whose resistance decreases with an increase in the fusing temperature to output a lower-voltage signal representing the fusing temperature.

3. The image forming apparatus according to claim 1, wherein the controller compares the detected fusing temperature with a predetermined reference fusing temperature and outputs the heater control signal according to a result of the comparison, the reference fusing temperature belonging to the first temperature range.

4. The image forming apparatus according to claim 1, further comprising:

a temperature switch electrically connected to the heater, wherein:

the temperature switch compulsorily cuts off power to the heater when the detected fusing temperature reaches an overheat protection temperature; and the second temperature range includes an upper temperature limit set to be lower than the overheat protection temperature.

5. The image forming apparatus according to claim 4, wherein the temperature switch is a bimetal.

6. The image forming apparatus according to claim 1, wherein the overheat prevention device comprises:

a comparator to change an output voltage thereof with a fusing temperature signal corresponding to the fusing temperature detected by the temperature sensor;

a first switch to perform a switching operation in response to the heater control signal from the controller to control the heater; and a second switch to perform a switching operation in response to the output voltage of the comparator to control the heater independent of the first switch.

7. The image forming apparatus according to claim 6, wherein the comparator has an inverting terminal to receive a voltage of the fusing temperature signal, a non-inverting terminal to receive a reference voltage, and an output terminal connected to the non-inverting terminal.

8. The image forming apparatus according to claim 7, wherein the voltage inputted to the inverting terminal of the comparator becomes lower than the voltage inputted to the non-inverting terminal of the comparator when the detected fusing temperature reaches an upper temperature limit of the second temperature range, and higher than the voltage inputted to the non-inverting terminal of the comparator when the detected fusing temperature reaches a lower temperature limit of the second temperature range.

9. The image forming apparatus according to claim 1, further comprising:

a power switch for switching power to be supplied to the heater, wherein the overheat prevention device controls an operation of the power switch such that the fusing temperature varies within a predetermined range.

10. The image forming apparatus according to claim 1, further comprising:

a power switch to switch power to be supplied to the heater, wherein:

the controller compares the detected fusing temperature with a predetermined reference fusing temperature and outputs a heater control signal to control the heater according to a result of the comparison such that the detected fusing temperature varies within a first temperature range; and the overheat prevention device controls the heater such that the detected fusing temperature varies within a second temperature range including the first temperature range.

11. The image forming apparatus according to claim 10, further comprising:

a bimetal to compulsorily cut off the power to the heater when the detected fusing temperature is higher than an overheat protection temperature and supplying the power to the heater when the detected fusing temperature is not higher than the overheat protection temperature, wherein the second temperature range includes an upper temperature limit set to be lower than the overheat protection temperature.

12. The image forming apparatus according to claim 10, wherein:

the overheat prevention device comprises:

a comparator to change an output voltage thereof with a fusing temperature signal corresponding to the fusing temperature detected by the temperature sensor, a first switch to perform a switching operation in response to the heater control signal from the controller to control the heater, and a second switch to perform a switching operation in response to the output voltage of the comparator to control the heater independent of the first switch;

the comparator has an inverting terminal to receive a voltage of the fusing temperature signal, a non-inverting terminal to receive a reference voltage, and an output terminal connected to the non-inverting terminal; and the voltage inputted to the inverting terminal of the comparator becomes lower than the voltage inputted to the non-inverting terminal of the comparator when the detected fusing temperature reaches an upper temperature limit of the second temperature range, and higher than the voltage inputted to the non-inverting terminal of the comparator when the detected fusing temperature reaches a lower temperature limit of the second temperature range.

13. An image forming apparatus comprising:

a fusing device to fuse an image on a printing medium;

a temperature sensor to detect a fusing temperature of the fusing device;

a controller to generate a heater control signal to control the fusing device according to the detected fusing temperature and a first reference; and an overheat prevention device to control the fusing device according to the detected fusing temperature and a second reference such that one of the controller and the overheat prevention device controls the fusing device when the other one of the controller and the overheat prevention device does not control the fusing device, wherein the overheat prevention device comprises:

a comparing unit to generate an overheat signal, and wherein the fusing device comprises:

a heater to be turned on and off according to one of the overheat signal and the heater control signal to maintain the fusing temperature in a predetermined range.

14. The image forming apparatus according to claim 13, wherein:

the fusing device comprises a heater to generate heat to fuse the image; and the overheat prevention device controls the heater when the controller is in an abnormal state in which the heater is kept being turned on.

15. The image forming apparatus according to claim 13, wherein:

the fusing device comprises a heater to generate heat to fuse the image; and the overheat prevention device controls the heater when the controller controls the heater to keep being turned on in an abnormal state

16. The image forming apparatus according to claim 13, wherein:

the second reference comprises a value range between a first value and a second value to represent a temperature range; and the overheat prevention device controls the fusing device according to the detected fusing temperature and one of the first value and the second value.

17. The image forming apparatus according to claim 13, wherein:

the second reference comprises a value range between a first value and a second value to represent a temperature range; and the first reference is in the value range.

18. The image forming apparatus according to claim 13, wherein the controller and the overheat prevention device independently control the fusing device.

19. An image forming apparatus comprising:

a fusing device including a heater to be turned on and off according to one of an overheat signal and a heater control signal to maintain a fusing temperature in a predetermined range to fuse an image on a printing medium;

a temperature sensor to detect the fusing temperature varying with an operation of the heater of the fusing device;

a controller to output the heater control signal to control the heater of the fusing device based on the detected fusing temperature and a first reference; and an overheat prevention device includes a comparing unit to generate the overheat signal to control the heater of the fusing device according to the detected fusing temperature and a second reference such that one of the controller and the overheat prevention device controls the fusing device when the other one of the controller and the overheat prevention device does not control the fusing device, and to prevent overheating of the fusing device when the heater control signal of the controller is abnormal.

20. An image forming apparatus comprising:

a fusing device including a heater to fuse an image on a printing medium;

a temperature sensor to detect a fusing temperature varying with an operation of the heater of the fusing device;

a controller to output a heater control signal according to the detected fusing temperature and a first reference such that the detected fusing temperature varies within a first temperature range; and an overheat prevention device to generate another heater control signal, and having a logic unit to control the fusing device according to at least one of the heater control signal and the another heater controller signal when the heater control signal of the controller is abnormal due to an error of the controller, such that the detected fusing temperature varies within a second temperature range including the first temperature range.

* * * * *